US008574088B1

(12) United States Patent
Burriss

(10) Patent No.: US 8,574,088 B1
(45) Date of Patent: Nov. 5, 2013

(54) PIVOTING SWING

(76) Inventor: C. Scott Burriss, Chapin, SC (US)

( * ) Notice: Subject to any disclaimer, the term of this patent is extended or adjusted under 35 U.S.C. 154(b) by 288 days.

(21) Appl. No.: 13/081,073

(22) Filed: Apr. 6, 2011

Related U.S. Application Data

(63) Continuation-in-part of application No. 12/378,238, filed on Feb. 12, 2009, now Pat. No. 7,951,012.

(51) Int. Cl.
*A63G 9/12* (2006.01)
*A63G 9/00* (2006.01)

(52) U.S. Cl.
USPC ..... 472/125; 472/118

(58) Field of Classification Search
USPC ..... 472/20, 118, 120–125, 119
See application file for complete search history.

(56) References Cited

U.S. PATENT DOCUMENTS

| | | | | | |
|---|---|---|---|---|---|
| 1,142,970 | A | * | 6/1915 | Koehler | 472/20 |
| 1,548,535 | A | * | 8/1925 | Lydecker | 104/81 |
| 2,448,325 | A | * | 8/1948 | Poorman, Jr. | 104/81 |
| 3,222,062 | A | * | 12/1965 | Segna et al. | 472/20 |
| 3,674,262 | A | * | 7/1972 | Tomalinas, Jr. | 472/118 |
| 4,190,248 | A | * | 2/1980 | Philippi | 472/120 |

* cited by examiner

*Primary Examiner* — Kien Nguyen
(74) *Attorney, Agent, or Firm* — Renner, Kenner, Greive, Bobak, Taylor & Weber

(57) ABSTRACT

A swing includes an annular track that carries a pair of moveable trolleys. Suspended from the trolleys by flexible suspension members is a support member, such as a swing seat. The support member may be moved to any desired position by moving the trolleys about the track, whereupon the trolleys may be locked in position. Once locked in the desired position, a user seated upon the support member is able to swing back and forth via the flexible suspension members.

9 Claims, 10 Drawing Sheets

PIVOTING SWING

CROSS-REFERENCE TO RELATED APPLICATION

This application is a continuation-in-part of U.S. patent application Ser. No. 12/378,238 filed on Feb. 12, 2009 now U.S. Pat. No. 7,951,012, the contents of which are incorporated herein by reference.

TECHNICAL FIELD

The present invention is generally directed to recreational swings. In particular, the present invention is directed to a pivoting swing that is able to be rotated in any direction. More particularly, the present invention is directed to a pivoting swing that moves about an annular track.

BACKGROUND ART

Recreational swings, such as porch swings, generally comprise a support structure, such as a seat, that is suspended by various chains or cables that span between the support structure of the swing and various hooks or other retainers that are affixed to a ceiling or other overhead support member. Thus, because such swings are rigidly affixed into the framework of a home or other structure, the users must identify the most desirable orientation of the swing prior to its installation. For example, users must weigh several considerations prior to installation of the swing, such as the position of the sun, whether the swing will be placed in a windward or leeward region, the aesthetic view of surrounding landscape, as well as other considerations. While the user may have taken many of these considerations into account prior to its installation, circumstances may exist where the user desires to have other points of view while using the swing. For example, during certain parts of the day, the sun may be directly in the user's field of view, and as such, the user may desire to reposition him or herself so that he or she is shielded from the sun. Unfortunately, in order to alter the position of current swings, the user must physically remove and reinstall the swing in a new location, which is generally impractical.

Therefore, there is a need for a swing that can be rigidly attached to a structure, such as a ceiling, whereby a flexibly-suspended support member can be rotated 360 degrees to a desired position, while allowing the support member to be swung back and forth. In addition, there is a need for a swing, whereby the pivoting support member can be selectively locked in position, so as to prevent further rotation.

SUMMARY OF THE INVENTION

In light of the foregoing, it is an aspect of the present invention to provide a swing for attachment to at least one overhead member, the swing comprising an at least partially annular track adapted to be attached to the at least one overhead member, first and second trolleys moveably attached to said track, and a support member attached to each said trolley by a flexible suspension member.

BRIEF DESCRIPTION OF THE DRAWINGS

These and other features and advantages of the present invention will become better understood with regard to the following description, appended claims, and accompanying drawings where:

BEST MODE FOR CARRYING OUT THE INVENTION

Figure 1:
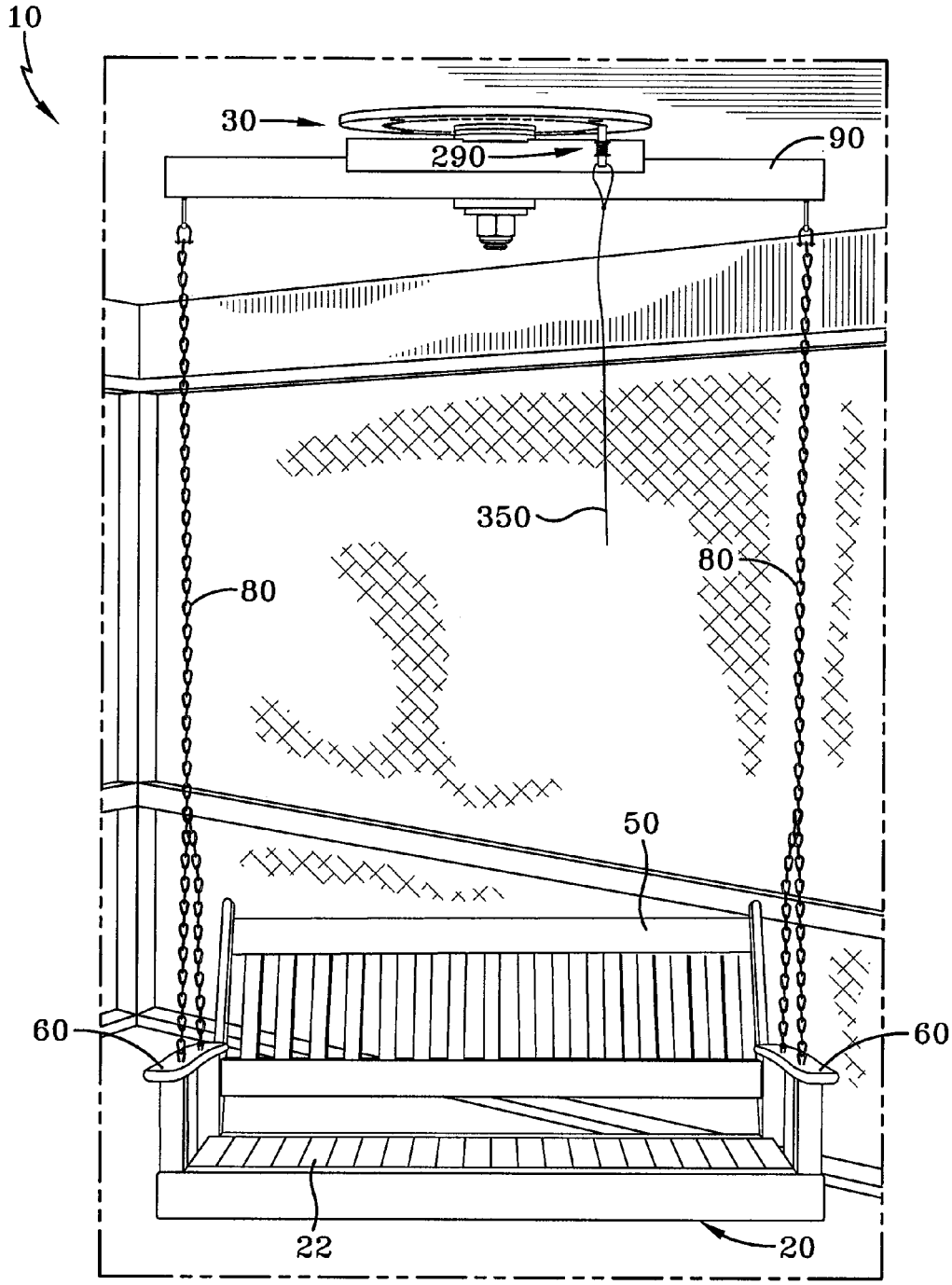
FIG. 1 is a perspective view of a pivoting swing in accordance with the concepts of the present invention.
Figure 2:
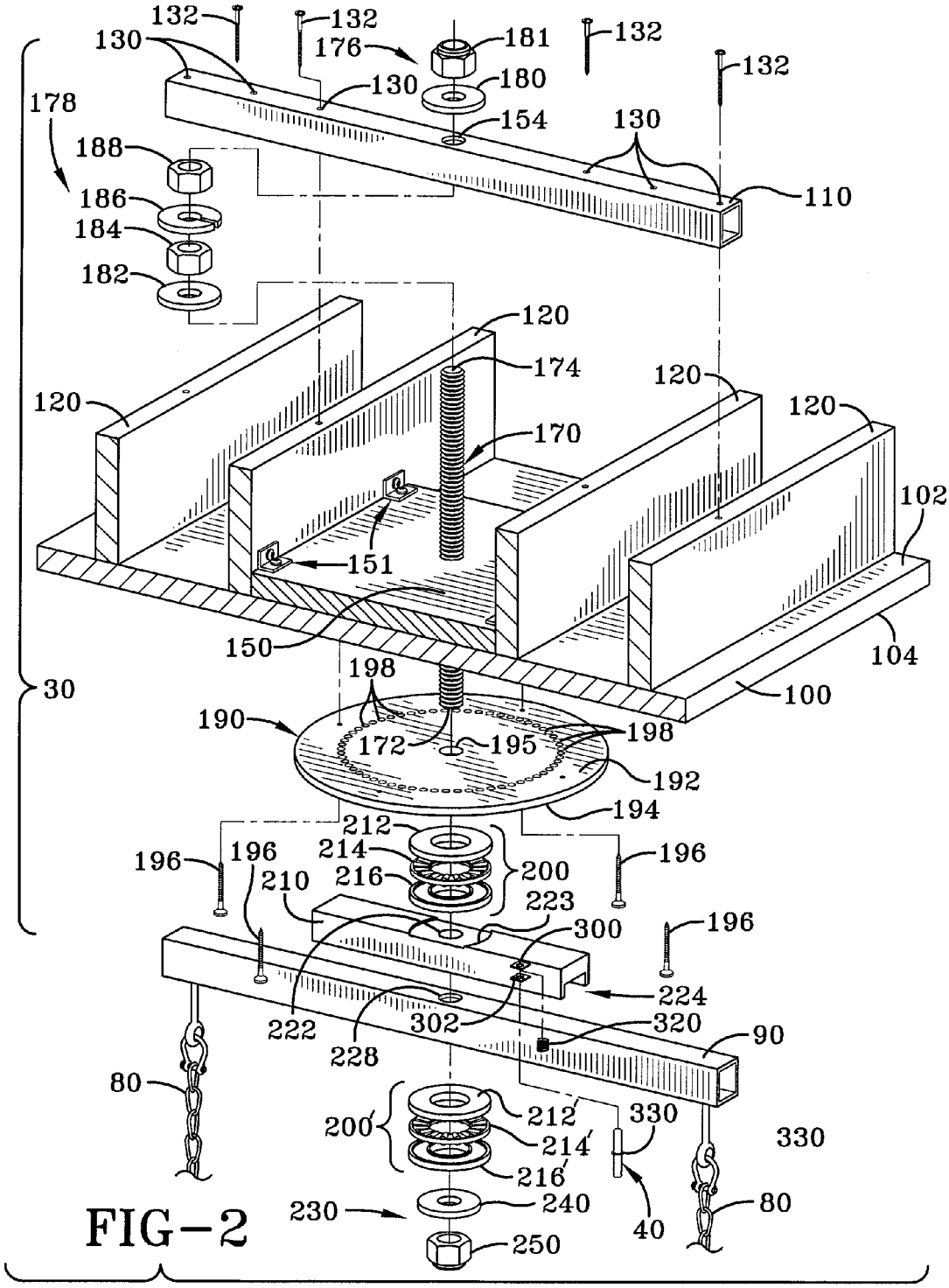
FIG. 2 is an exploded view of the pivoting swing in accordance with the concepts of the present invention.
Figure 3:
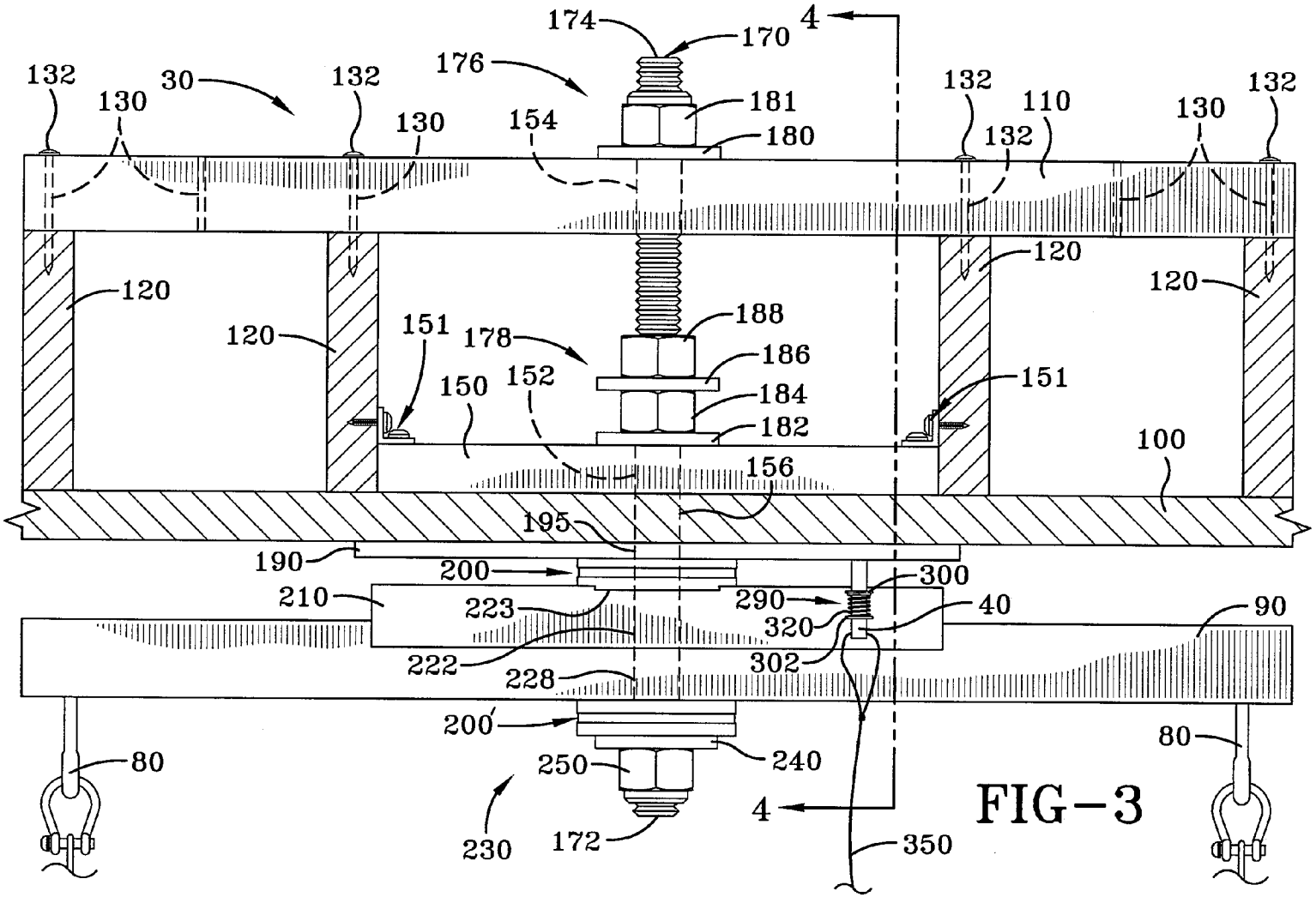
FIG. 3 is a front elevational view of the pivot assembly maintained by the pivoting swing in accordance with the concepts of the present invention.
Figure 4:
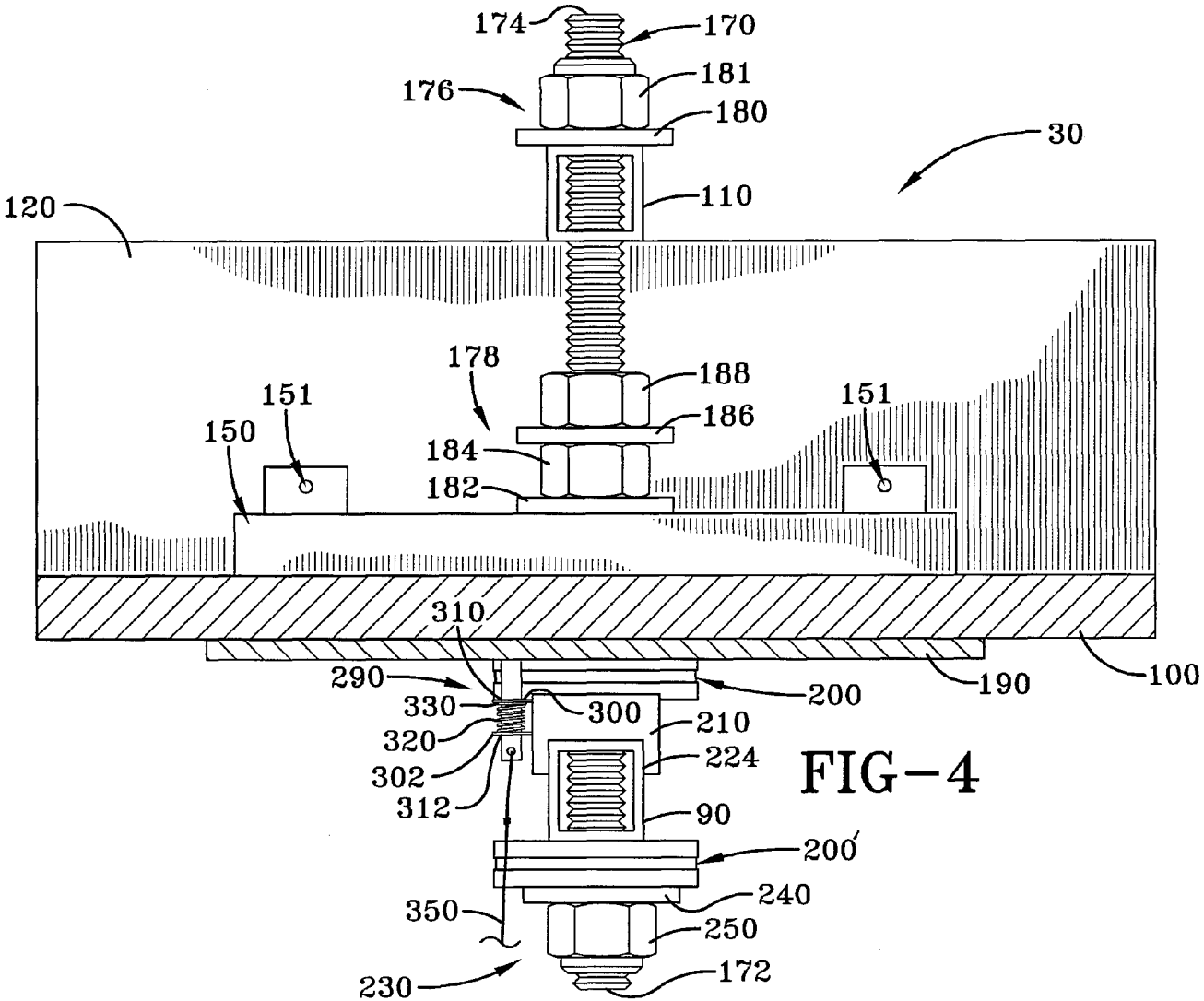
FIG. 4 is a side elevational view of the pivot assembly shown in FIG. 3 in accordance with the concepts of the present invention.
Figure 5:
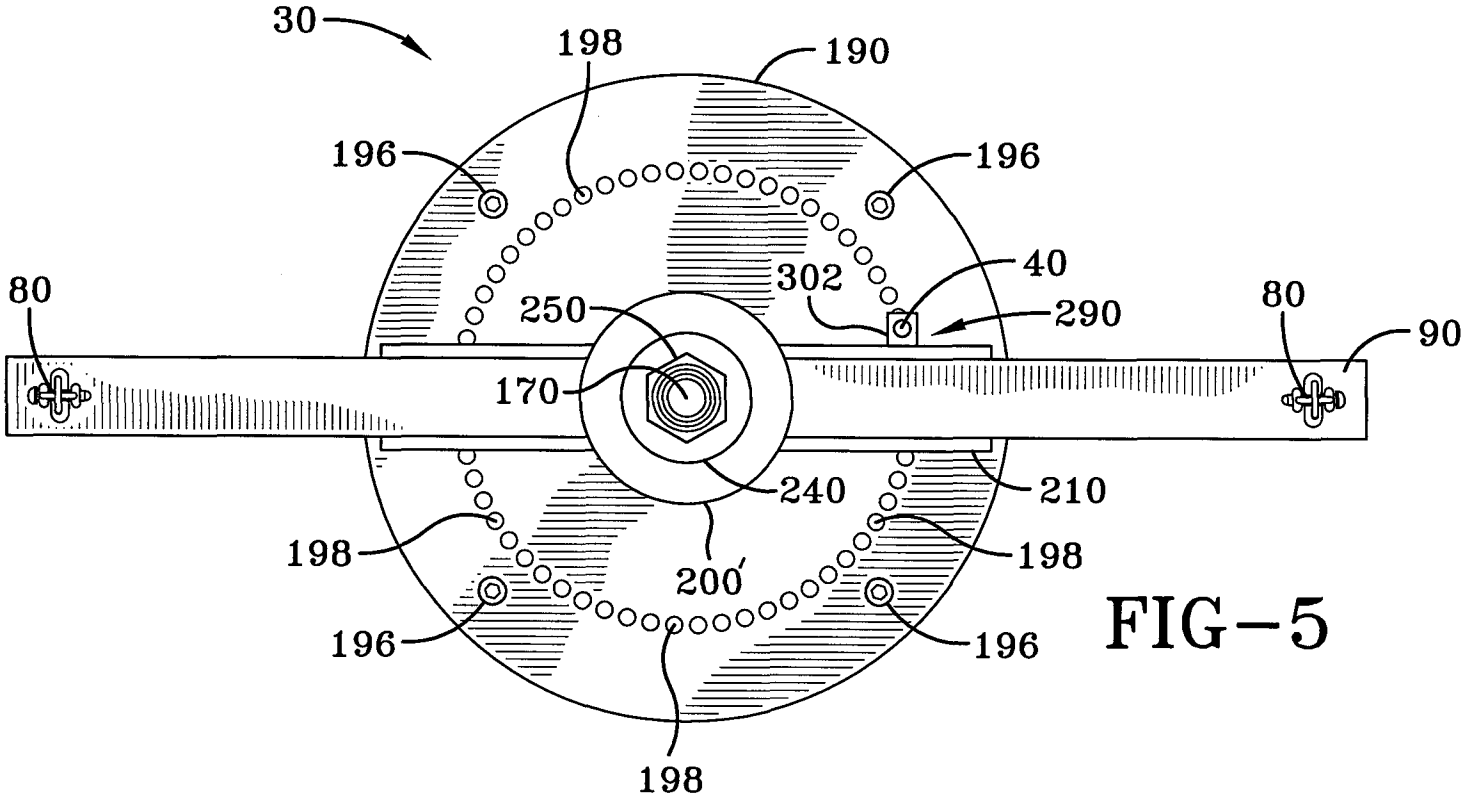
FIG. 5 is a bottom plan view of the pivot assembly in accordance with the concepts of the present invention.

A pivoting swing is generally referred to by the numeral 10, as shown in FIG. 1 of the drawings. The swing 10 includes a support assembly 20 that is suspended from a pivot assembly 30, which allows the support assembly 20 to be rotated 360 degrees to a desired position. The support assembly 20 comprises a support member 22 that is suitable for the user to sit upon, while allowing the user to swing backward and forward. As such, the swing 10 allows the user to rotate the position of the support assembly 20 about a 360-degree range, and once in position, is permitted to swing forward and backward. The pivot assembly 30 also includes a locking pin 40 that allows the user of the swing 10 to selectively lock the support assembly 20 in place once it has been rotated into a desired position.

The support assembly 20 comprises the support member 22, which allows users to sit thereupon. The support member 22 may also include a back member 50 that provides support to the user when he or she is seated upon the support member 22. The support assembly 20 may also include various extension members 60, such as arm supports, that are attached to the support member 22 and/or to the back 50. Attached at one end to either of the support member 22 or the back member 50 are suspension members 80 that are attached at another end to a carrying member 90, which serves to carry the support assembly 20. The suspension members 80 comprise any suitable length and may comprise a chain, cable, cord, flexible band, or any other means suitable for flexibly carrying the support assembly 20. It should also be appreciated that the suspension members 80 are configured so as to allow a user seated upon the support assembly 20 to freely swing or translate forward and backward. Additionally, the carrying member 90 comprises any suitable section of material, such as steel, aluminum, or plastic, that is capable of carrying the weight of the user when seated upon the support member 22. Moreover, the carrying member 90 may take on any suitable shape, including rectilinear, curvilinear, or a combination of both.

The pivot assembly 30, shown in FIGS. 2-5, is configured to be mounted to an existing ceiling member 100, having an inner surface 102 opposite an outer surface 104. The ceiling member 100 is spaced apart from a transverse reinforcement member 110 maintained by the pivot assembly 30 by a plurality of beam members 120, such as the joists typically found in a house. That is, the reinforcement member 110 is disposed upon the beam members 120 and is oriented at a generally right angle thereto. To retain the reinforcement member 110 to the beam members 120, the reinforcement member 110 includes one or more spaced apertures 130 along its length, which are dimensioned to receive suitable fasteners 132, such as wood screws, therethrough for receipt by the beam members 120. In one aspect, the apertures 130 maintained by the reinforcement member 110 may be spaced apart at varying intervals to accommodate the attachment of the reinforcement member 110 to beam members 120 that may be spaced at various intervals as well. The pivot assembly 30 also includes a support section 150 that is disposed in the region between two of the beam members 120 and placed adjacent the inner surface 102 of the ceiling member 100, using any suitable fastener, such as brackets 151, as well as adhesive, screws, nails, and the like.

In addition, the support section 150 maintains an aperture 152 that is axially aligned with an aperture 154 maintained by the reinforcement member 110 and an aperture 156 that is maintained by the ceiling member 100. As such, the apertures 152, 154, and 156 are configured so that they are coaxial with one another, so as to receive a shaft 170 having ends 172 and 174 therethrough. While the shaft 170 is shown with threads throughout its length, the shaft 170 may be configured with threads only in the regions where they are needed for attachment purposes to be discussed.

To retain the shaft 170 to the reinforcement member 110 and to the support section 150, a pair of retention assemblies 176 and 178, respectively, are used. In particular, the retention assembly 176, which supports the shaft 170 upon the reinforcement member 110, comprises a flat washer 180 that is disposed adjacent to the reinforcement member 110 and a locking nut 181 that is threadably received by complementary threads maintained by the shaft 170. The retention assembly 178, which supports the shaft 170 upon the support section 150 comprises a flat washer 182 that is disposed adjacent to the support section 150, a nut 184 that is disposed adjacent to the flat washer 182, a locking washer 186 that is disposed adjacent to the nut 184, and a nut 188 that is threadably received by complementary threads (not shown) maintained by the shaft 170. It should also be appreciated that the retention assemblies 176 and 178 may comprise any other suitable means of retaining the shaft 170 to the reinforcement member 110 and to the ceiling member 100.

A lock plate 190 having an inner surface 192 opposite an outer surface 194 maintains a centrally-disposed aperture 195 that receives the shaft 170 therethough. The lock plate 190 is retained, such that its inner surface 192 is adjacent to the outer surface 104 of the ceiling member 100, by any suitable fasteners 196, such as screws, which are threadably received by the ceiling member 100 and/or the support section 150. The lock plate 190 also includes a plurality of lock apertures 198 that are configured to receive the lock pin 40 to be discussed.

A bearing assembly 200 is carried upon the shaft 170 between the outer surface 194 of the lock plate 190 and a rotating arm 210. Specifically, the bearing assembly 200 comprises a washer 212 disposed adjacent the outer surface of the lock plate 190; a bearing 214, such as a thrust bearing, disposed adjacent washer 212; and a thrust washer 216 disposed adjacent thrust bearing 214. As such, the bearing assembly 200 enables the rotating arm 210 to freely pivot in a 360-degree range with respect to the lock plate 190. It should be appreciated that the thrust washer 216 is configured to engage the surface of the rotating arm 210.

The rotating arm 210 maintains a centrally-disposed aperture 222 within a bearing retainer 223 to receive the shaft 170 therethrough. The bearing retainer 223 is dimensioned to retain the thrust washer 216 therein so that the rotating arm 210 is able to freely rotate. The rotating arm 210 also maintains a channel 224 that is dimensioned to receive the cross-sectional dimension of the carrying member 90 therein. For example, as shown clearly in FIG. 4, the channel 224 may be configured to have a rectangular cross-section, which is suitable for receiving the rectangular cross-section of the carrying member 90. And while a rectangular cross-section is discussed for use with the rotating arm 210 and the carrying member 90, such should not be construed as limiting, as any other suitable complementary cross-sectional shape may be used. As such, the channel 224 imparts the rotating movement of the rotating arm 210 to the carrying member 90.

The carrying member 90, which is received within the channel 224 of the rotating arm 210, maintains an aperture 228 that receives the shaft 170 therethrough. Also carried by the shaft 170 is a bearing assembly 200' that, together with the bearing assembly 200, enables the carrying member 90 to freely rotate about a 360-degree range. The bearing assembly 200' is comprised of washer 212' that is configured to engage the surface of the carrying member 90; a bearing 214', such as a thrust bearing, disposed adjacent washer 212'; and a thrust washer 216' disposed adjacent thrust bearing 214'. The bearing assembly 200' is retained upon the shaft 170 by a fastening assembly 230 attached to the end 172 of the shaft 170. Specifically, the fastening assembly 230 comprises a flat washer 240 that is disposed adjacent to the bearing assembly 200' and a nut 250 that is threadably received by the shaft 170. As such, when the nut 250 is tightened, a compressive force is applied between the carrying member 90 and the rotating arm 210, so as to retain the carrying member 90 within the channel 224 of the rotating arm 210. Furthermore, by tightening the nut 250, force is generated between the retention assemblies 176 and 178 that are respectively carried upon the reinforcement member 110 and the ceiling member 100 to further anchor the swing 10.

It should be appreciated that while the rotating arm 210 and the carrying member 90 are shown to extend at a substantially right angle from the shaft 170, such should not be construed as limiting, as the rotating arm 210 and/or carrying member 90 may extend at other angles and orientations.

To lock the position of the carrying member 90 with respect to the lock plate 190, a lock assembly 290 is maintained by the rotating arm 210. The lock assembly 290 includes a pair of spaced protrusions 300 and 302 that include respective apertures 310,312 and a spring 320 that is axially aligned therewith to receive the pin 40 therethrough. The pin 40 includes one or more tabs 330, such as a tab that circumscribes the pin 40, which engages the spring 320, so as to bias the lock pin 40 in a locked state, such that it is received within one the lock apertures 198 maintained by the lock plate 190, thus locking the position of the carrying arm 90 to the lock plate 190. As a result, the support assembly 20 is not permitted to rotate about its 360-degree range of travel. It should be appreciated that the lock apertures 198 are disposed in the lock plate 190 so that they are aligned with the arcuate or curved path that lock pin 40 travels when the rotating arm 210 is moved.

Thus, when the user desires to pivot or rotate the support assembly 20, he or she pulls on a line 350 attached to the lock pin 40 to overcome the bias of the spring 320 so that the pin 40 is placed in an unlocked state, such that it is no longer received within the lock aperture 198, and whereby the carrying member 90 is freely rotatable about its 360-degree range. Once a desired position is found, the line 350 is released so that the lock pin 40 is again received within one of the lock apertures 198, so as to prevent the carrying member 90 from further rotation. As such, a user seated upon the support assembly 20 of the swing 10 can swing both forward and backward, as well as pivot about a 360-degree range to obtain the most desirable vantage point.

It should also be appreciated that the lock pin 40 may also be configured to be permanently placed in an unlocked position using known techniques so that it does not engage any of the lock apertures 198, thereby allowing the carrying member 90 to freely rotate in a 360-degree range at all times.

Figure 6:
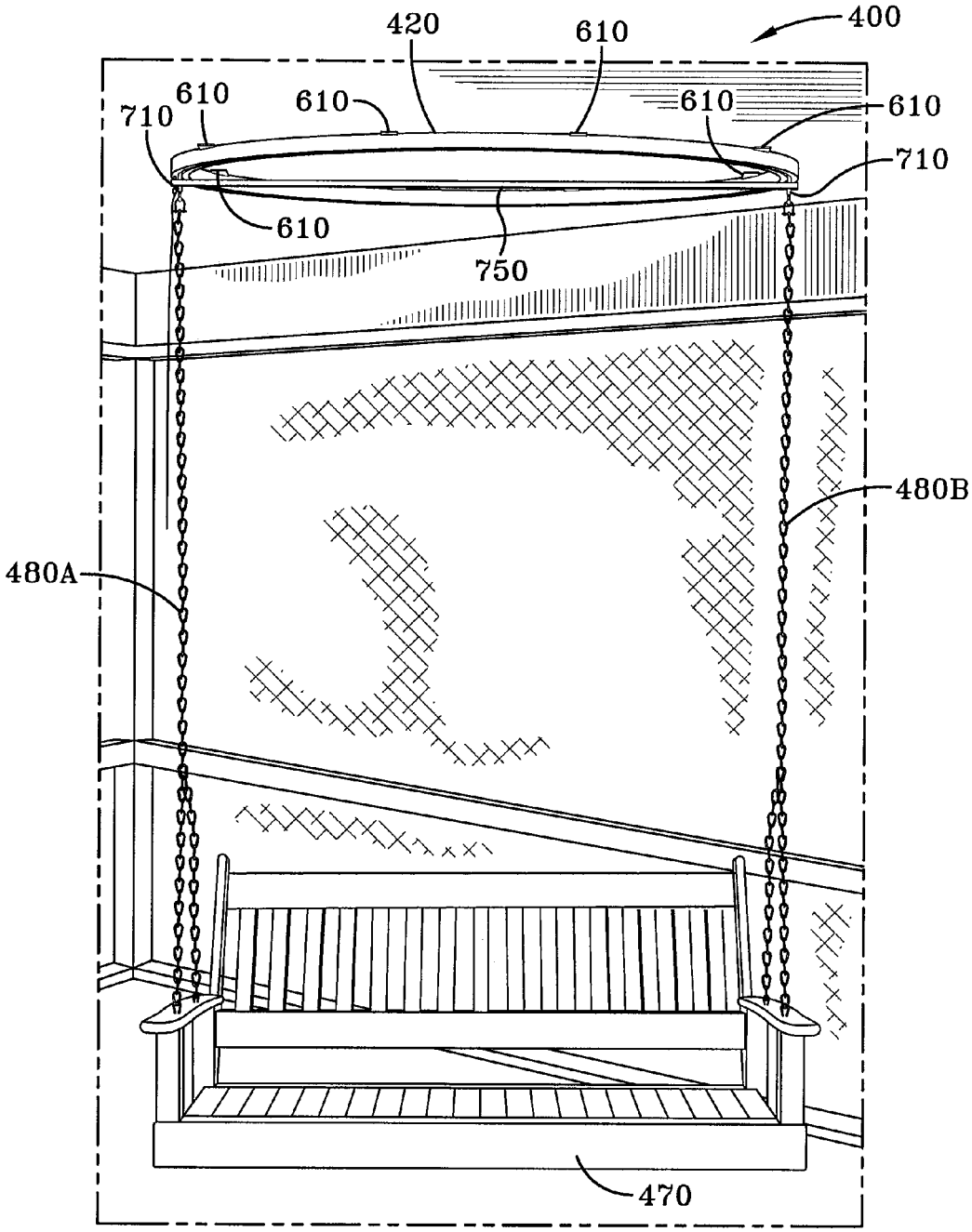
FIG. 6 is a perspective view of an alternative swing in accordance with the concepts of the present invention.
Figure 7:
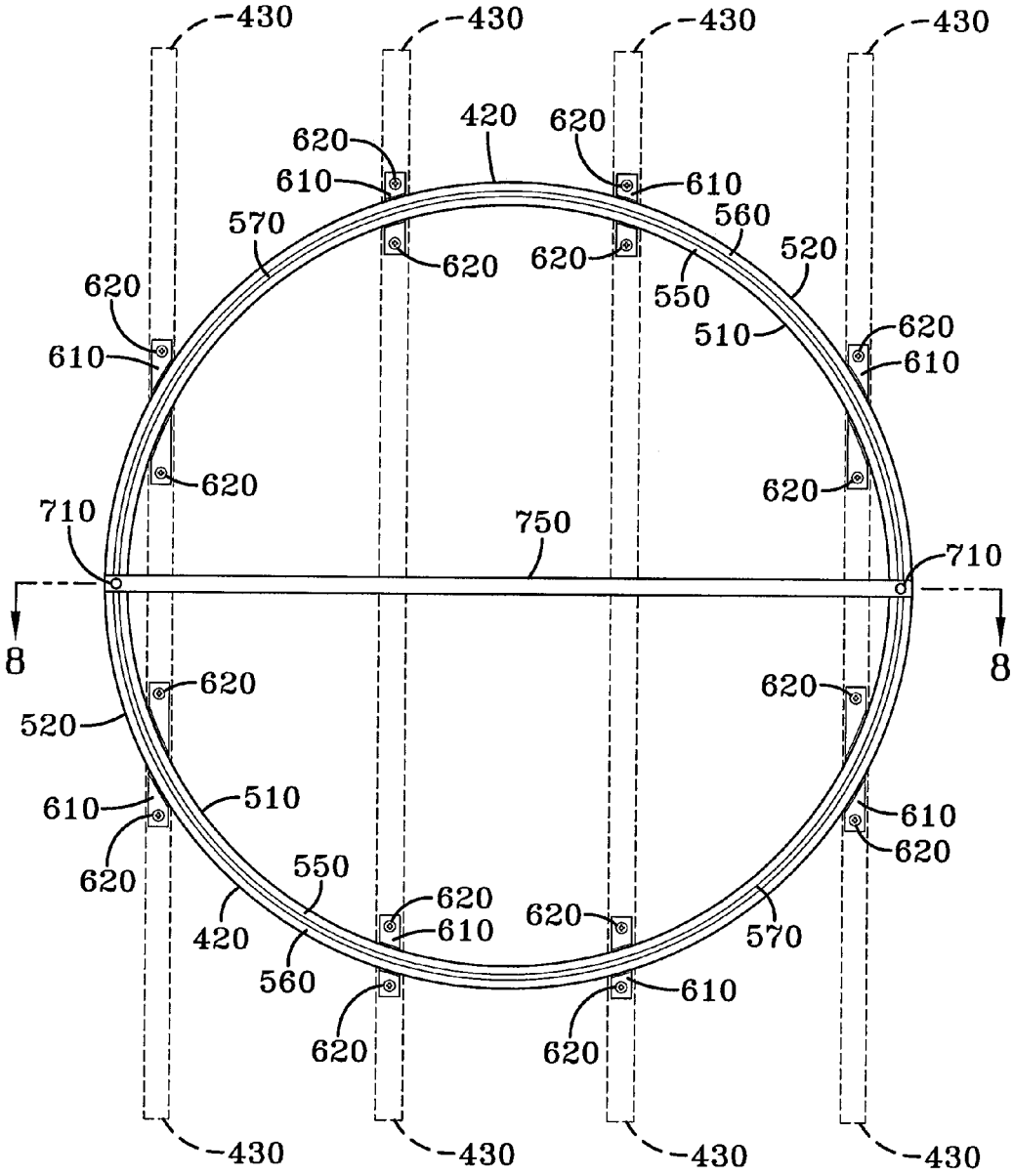
FIG. 7 is a plan view of the guide track used by the alternative swing in accordance with the concepts of the present invention.

In another embodiment, a swing is generally referred to by the numeral 400, as shown in FIG. 6 of the drawings. The swing 400 includes an annular track 420 that is configured to be attached to one or more overhead members 430, such as ceiling joists, as shown in FIG. 7. The annular track 420 carries a pair of trolleys 450A and 450B that rotate along the track 420. A support member 470, such as a swing seat or any other support structure, is suspended or otherwise attached to each of the trolleys 450A,450B by respective suspension members 480A and 480B. In one aspect, the support members 480A-B may comprise any suitable structure, including a rigid material, a flexible material, or a combination of both. For example, the suspension members 480A-B may comprise a chain, cord, cable, bar or the like. As such, a user of the swing 400 is able to sit on the support member 470 and rotate it to a desired position to obtain a desired view, while still being able to swing back and forth. For example, the user of the swing 400 may rotate the support member 470 so that they are in a desirable position, such as to put the sun or the wind at their back so that it is not in their face.

Figure 9:
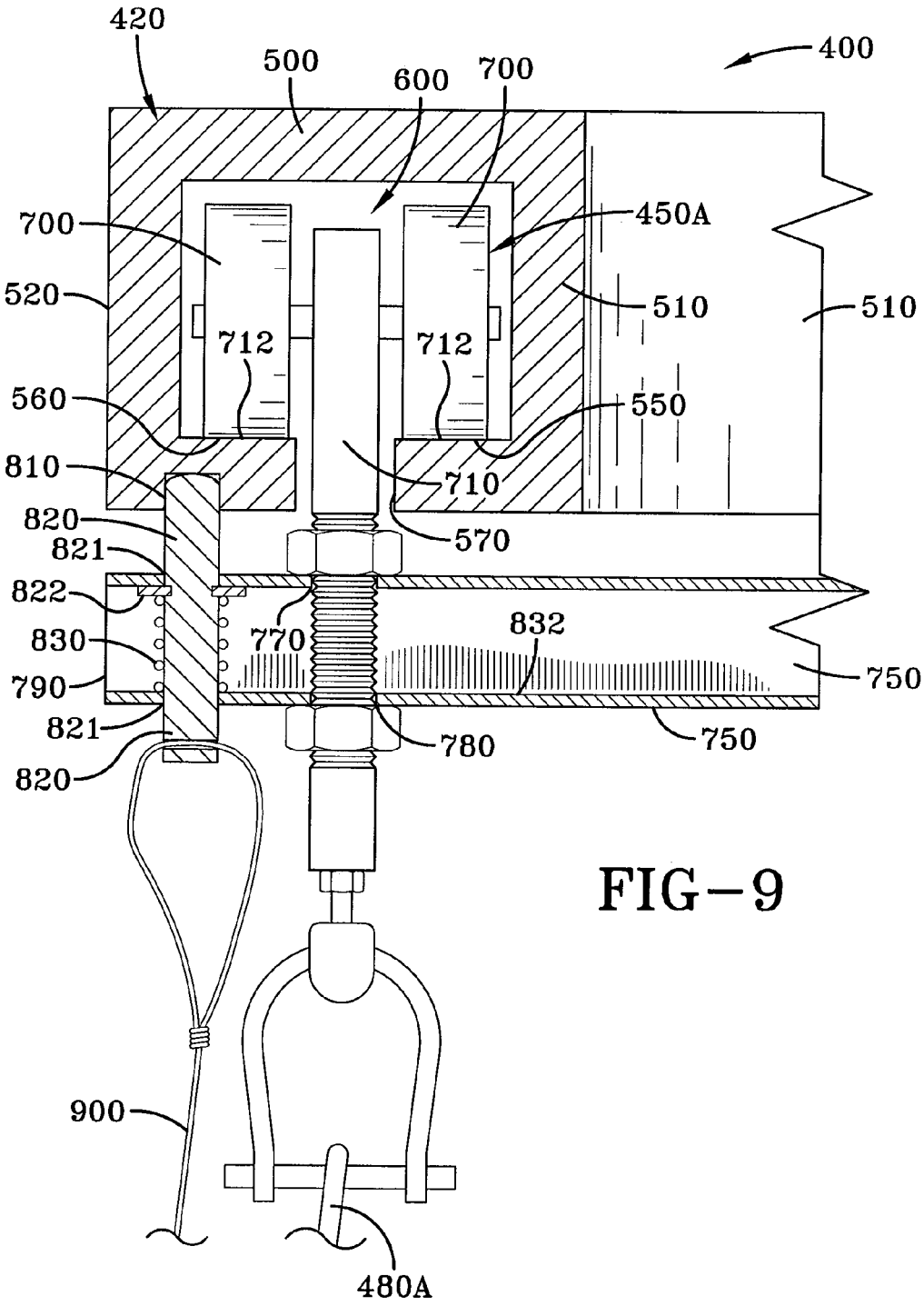
FIG. 9 is a cross-sectional view of the guide track showing the trolley used by the alternative swing in accordance with the concepts of the present invention.

The annular track 420, as shown in FIG. 9, is comprised of a substantially square cross-section that includes an annular mounting section 500 from which spaced inner and outer annular guide members 510 and 520 extend at a substantially right angle thereto. Extending from the ends of the inner and outer guide members 510 and 520 at a substantially right angle are respective inner and outer engagement members 550 and 560 that are spaced apart by a slot 570. As such, the spaced annular guide members 510,520 and inner and outer engagement members 550,560 are concentric with each other, and together with the mounting section 500, serve to form a guide channel 600 therein. However, it should be appreciated that the annular track 420 may be configured to have any desired cross-sectional shape, such as a curvilinear cross-section, a rectilinear cross-section, or a combination of both. It should also be appreciated that the track 420 may be formed from any suitable material, such as aluminum, steel, or reinforced plastic, for example. A plurality of attachment plates 610, as shown in FIG. 7, having one or more attachment apertures 620 are attached to the mounting section 500, to enable the attachment of the track 420 to one or more of the various overhead members 430, such as ceiling joists or any other suitable structural support member.

The trolleys 450A-B are each disposed within the guide channel 600, and because the trolleys 450A-B are structurally equivalent, only the structural components of trolley 450A will be discussed herein. Specifically, the trolley 450A includes a pair of rollers 700 that are rotatably coupled to an attachment shaft 710. The rollers 700 are spaced so that they ride upon a contact surface 712 disposed upon the inner and outer engagement members 550,560, while the attachment shaft 710 extends through the slot 570. It should be appreciated that the trolleys 450A-B may be configured with only one roller 700 that is configured to be carried upon the only one of the inner or outer engagement members 550,560. It should also be appreciated that in lieu of the rollers 700, the trolley 450A may utilize any item that is capable of sliding within the guide channel 600, such that it rides upon one or both of the engagement members 550,560. For example, the trolley 450A may comprise a slide bar 713, shown in FIG. 10, that extends at a substantially right angle to the attachment pin 710A and rests upon the engagement members 550,560 of the track 420, while allowing the attachment shaft 710 attached thereto to slide within the annular slot 570. In one aspect, the contact surface 712 of the engagement members 550,560 may be coated with TEFLON or any other suitable material, to facilitate the sliding action of the slide bar 713 upon the contact surfaces 712 of the engagement members 550,560.

Figure 8:
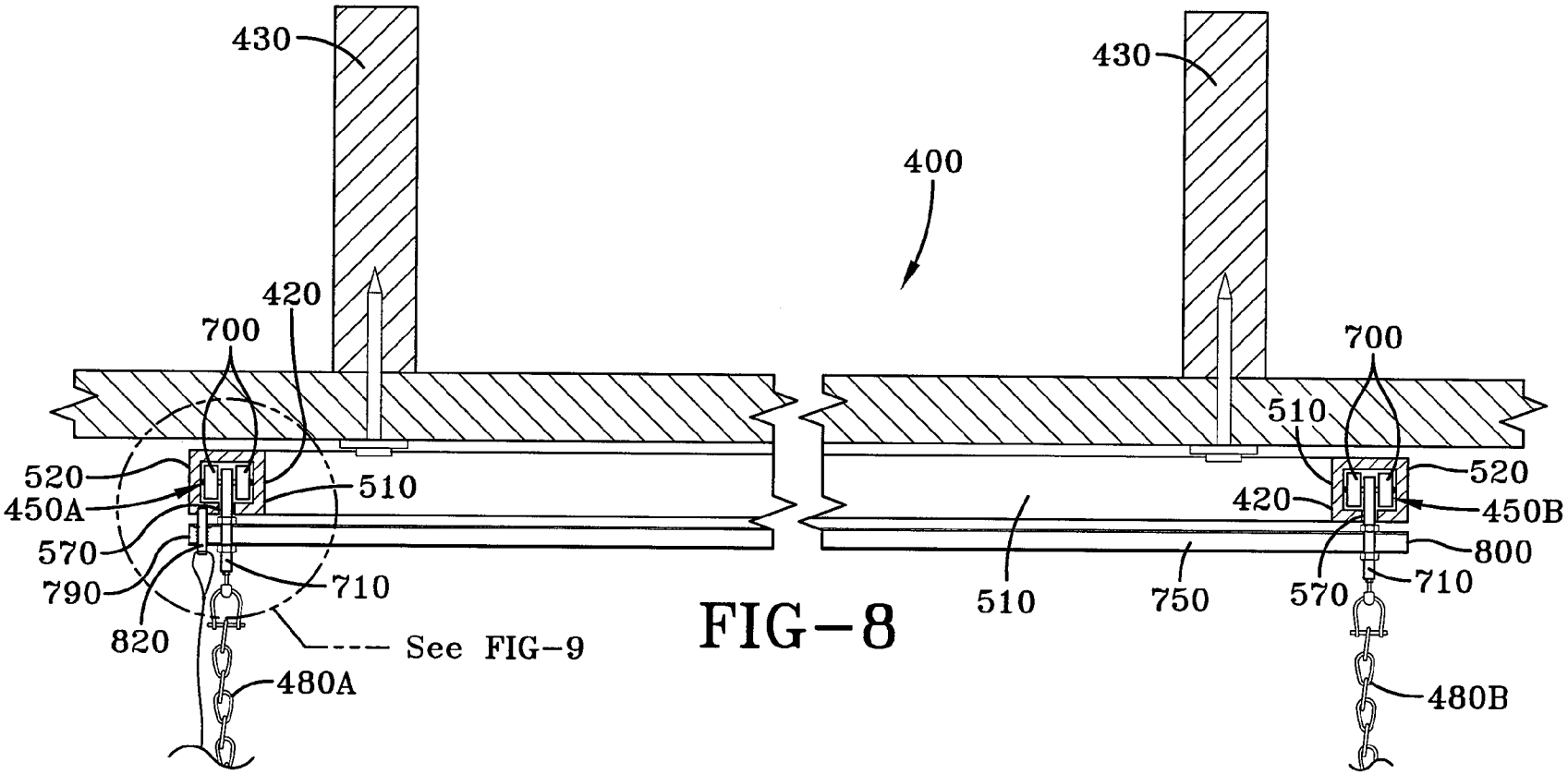
FIG. 8 is a cross-sectional view of the guide track shown in FIG. 7 in accordance with the concepts of the present invention.

Extending between and attached to the attachment shafts 710 of each of the respective trolleys 450A and 450B is a connection arm 750, as shown in FIG. 8, that comprises any suitable rigid member. Specifically, the connection arm 750 comprises an elongated member having attachment apertures 770 and 780 disposed at each of its respective ends 790 and 800. The attachment apertures 770,780 are dimensioned to receive attachment shaft 710 provided by each trolley 450A-B therethrough. The attachment shafts 710 are secured to the connection arm 750 using any suitable means of fixation, including adhesive, welding, threaded connection (bolt/nut), or the like. It should be appreciated that the connection arm 750 may be formed from any suitable material, such as steel, aluminum, wood, plastic, or the like. As such, the trolleys 450A and 450B allow the support member 470 to be rotated about a 360-degree range provided by the track 420.

Figure 10:
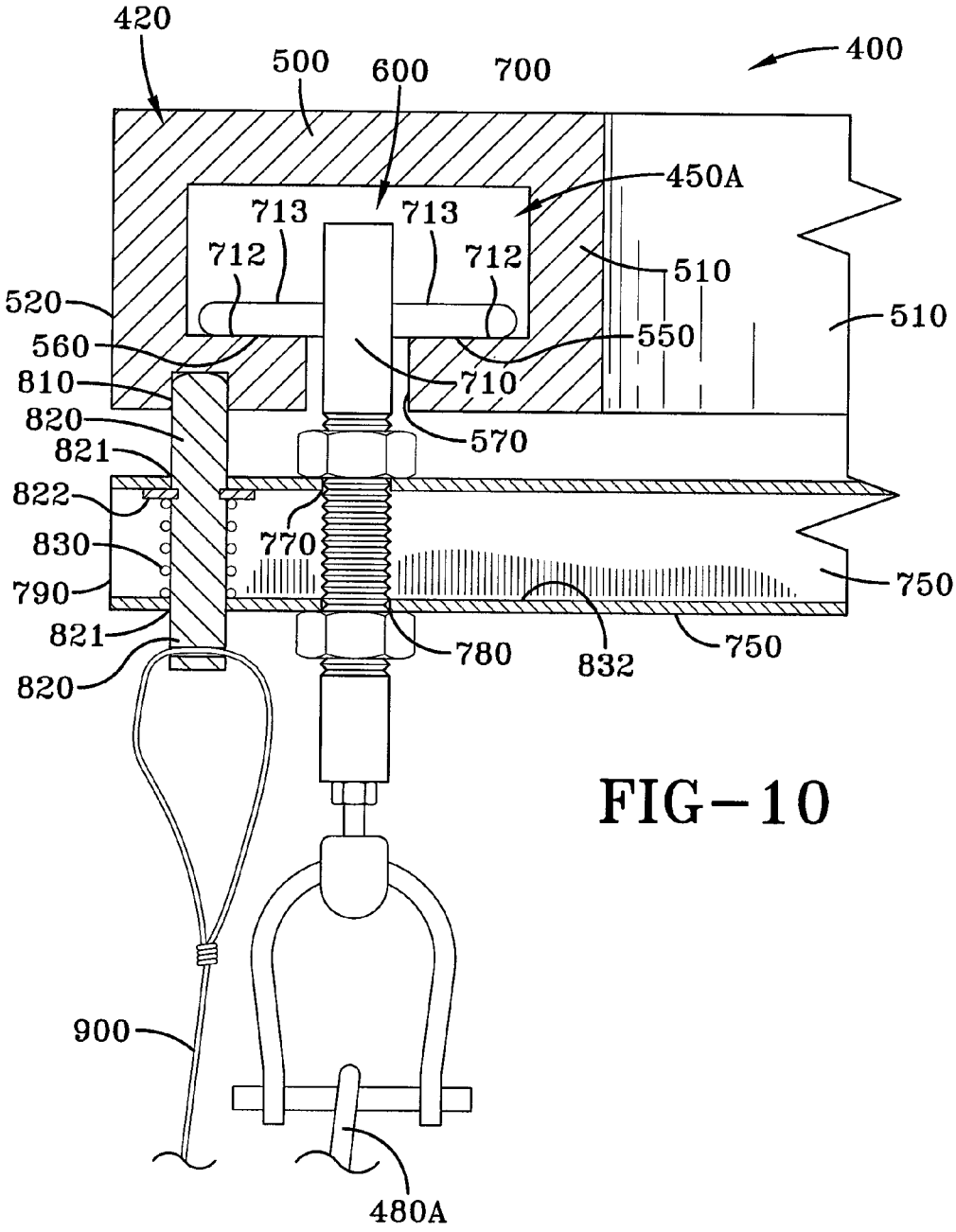
FIG. 10 is a cross-sectional view of the guide track showing the trolley used by the alternate swing comprising a slide bar in accordance with the concepts of the present invention.

It is also contemplated that the swing 400 includes a locking system, as shown in FIGS. 9-10, whereby one or more lock apertures 810 are disposed throughout the circumference of the outer engagement member 560 of the guide track 420. The lock apertures 810 extend partially within the engagement member 560 and are dimensioned to receive a lock pin 820 therein. The lock pin 820 is slideably carried within a slide aperture 821 that is disposed through the connection arm 750. The lock pin 820 includes a stop 822 that is disposed about the periphery of the pin 820. As such, the lock pin 820 is received within a spring 830, such that the spring 830 is retained between the stop 822 and an inner wall 832 of the connection arm 750. As such, the lock pin 820 extends through the slide aperture 821 when the lock pin 820 is in its normally biased position and is received within the lock aperture 810 of the track 420. As such, the trolleys 450A-B and the connection arm 750 are locked into place, preventing the trolleys 450A-B from moving, thus keeping the position of the support member 470 fixed in position. When the lock pin 820 is moved from its normally biased position, such as by pulling a cord 900 attached to the lock pin 820, the pin 820 is removed from the lock aperture 810, allowing the connection arm 750 and support member 740 to be rotated and subsequently locked into a newly desired position.

It should be appreciated that the lock apertures 810 may be disposed in the inner engagement member 550 in lieu of the outer engagement member 560.

Therefore, one advantage of the present invention is that a swing of the present invention allows the user to rotate a support assembly about a 360-degree range to achieve a plurality of different vantage points without the need of reinstalling the swing in a new position. Still another advantage of the swing of the present invention is that users can freely rotate the support assembly to a desired position, where it can be locked in place. Yet another advantage of the present invention is that the swing is able to absorb any imbalance in weight distribution on the support member, without causing a change in the overall height of the support member.

Thus, it can be seen that the objects of the invention have been satisfied by the structure and presented above. While in accordance with the Patent Statutes, only the best mode and preferred embodiment have been presented and described in detail, it being understood that the invention is not limited thereto or thereby. Accordingly, for an appreciation of the true scope and breadth of the invention, reference should be made to the following claims.

The invention claimed is:

1. A swing for attachment to at least one overhead member, the swing comprising:

an at least partially annular track adapted to be attached to the at least one overhead member;

first and second trolleys moveably carried by said track, said first and second trolleys each including an attachment shaft extending therefrom, such that each said attachment shaft extends below said track;

a connection arm attached to each said attachment shaft, so as to extend between said first and second trolleys beneath said track; and a support member attached to each said attachment shaft by a flexible suspension member.

2. The swing of claim 1, wherein said first and second trolleys comprise at least one roller.

3. The swing of claim 1, wherein said first and second trolleys comprise at least one slide bar.

4. The swing of claim 1, wherein said track comprises at least one engagement member upon which said first and second trolleys are carried.

5. The swing of claim 4, wherein said first and second trolleys comprise at least one roller that moves upon said at least one engagement member.

6. The swing of claim 4, wherein said first and second trolleys comprise at least one slide bar that slides upon said at least one engagement member.

7. A swing for attachment to at least one overhead member, the swing comprising:

an at least partially annular track adapted to be attached to the at least one overhead member;

first and second trolleys moveably carried by said track;

a support member attached to each said trolley by a suspension member;

a connection arm attached to and extending between each said trolley; and a pin slideably carried by said connection arm, said pin configured to be selectively received within at least one lock aperture disposed in said track, so as to lock said connection arm to said track.

8. The swing of claim 7, wherein said pin is spring biased.

9. The swing of claim 7, wherein each said suspension member is flexible.

* * * * *